United States Patent [19]

Maddocks

[11] Patent Number: 5,012,256

[45] Date of Patent: Apr. 30, 1991

[54] ARRAY ANTENNA

[75] Inventor: Mark C. D. Maddocks, Reigate, United Kingdom

[73] Assignee: British Broadcasting Corporation, London, England

[21] Appl. No.: 146,373

[22] PCT Filed: May 13, 1987

[86] PCT No.: PCT/GB87/00329

§ 371 Date: Jan. 26, 1988

§ 102(e) Date: Jan. 26, 1988

[87] PCT Pub. No.: WO87/07772

PCT Pub. Date: Dec. 17, 1987

[30] Foreign Application Priority Data

Jun. 2, 1986 [GB] United Kingdom ..... 8613322

[51] Int. Cl.[5] ..... H01Q 21/06; H01Q 19/30; H01Q 3/30

[52] U.S. Cl. ..... 343/754; 343/757; 343/813; 343/814; 343/815; 343/818; 342/368

[58] Field of Search ..... 343/795, 754, 700 MS File, 343/803, 804, 810–812, 814–820, 824, 827, 813, 821, 757, 853

[56] References Cited

U.S. PATENT DOCUMENTS

| | | | |
|---|---|---|---|
| 2,217,321 | 10/1940 | Runge et al. | 343/813 |
| 2,409,944 | 10/1946 | Loughren | 343/814 |
| 3,214,760 | 10/1965 | Yonkers | 343/818 |
| 3,541,559 | 11/1970 | Evans | 343/795 |
| 3,587,110 | 6/1971 | Woodward | 343/814 |
| 3,599,217 | 8/1971 | Grant | 343/818 |
| 3,997,900 | 12/1976 | Chin et al. | 343/705 |
| 4,097,868 | 6/1978 | Borowick | 343/795 |
| 4,336,543 | 6/1982 | Ganz et al. | 343/815 |
| 4,370,657 | 1/1983 | Kaloi | 343/700 MS File |
| 4,490,723 | 12/1984 | Hardie et al. | 343/754 |
| 4,575,728 | 3/1986 | Theobald et al. | 343/813 |
| 4,623,893 | 11/1986 | Sabban | 343/700 MS File |
| 4,812,855 | 3/1989 | Coe et al. | 343/813 |
| 4,823,144 | 4/1989 | Guy | 343/853 |

FOREIGN PATENT DOCUMENTS

| | | | |
|---|---|---|---|
| 1441640 | 10/1969 | Fed. Rep. of Germany . | |
| 2138384 | 2/1973 | Fed. Rep. of Germany | 343/700 MS File |
| 97703 | 7/1980 | Japan | 343/700 MS File |
| 61203 | 4/1984 | Japan | 343/700 MS File |
| 237076 | 10/1986 | Japan | 343/700 MS File |
| 827328 | 2/1960 | United Kingdom . | |
| 1271346 | 4/1972 | United Kingdom . | |
| 1387450 | 3/1975 | United Kingdom . | |
| 1503598 | 3/1978 | United Kingdom . | |
| 1505074 | 3/1978 | United Kingdom . | |
| 2117184 | 10/1983 | United Kingdom . | |
| 2150356 | 6/1985 | United Kingdom . | |
| 2161652 | 1/1986 | United Kingdom | 343/700 MS File |
| 2166600 | 5/1986 | United Kingdom . | |

OTHER PUBLICATIONS

Dubost et al., "Log Periodic Flat Short-Circuited Dipole Array with a Squinted Beam", Electronics Letters, vol. 20, No. 10, May 10, 1984, pp. 411–413.

*Primary Examiner*—Michael C. Wimer

*Attorney, Agent, or Firm*—Robert F. O'Connell

[57] ABSTRACT

A radiating element comprises a groundplane, a dielectric layer and a conductive pattern comprising a folded dipole (20, 21), a feed line (18, 19) for the dipole and a plurality of closely spaced directors (22), all lying in a common plane parallel to the ground plane. An array of such elements with a suitable feed network provides a flat antenna with a squinted beam. The squint angle can be adjusted by adjusting the phase delay between columns of elements. The beam can be steered by selection of the appropriate squint angle and by rotationally adjusting the antenna in its own plane. The antenna is suitable as a less obtrusive alternative to a dish antenna.

26 Claims, 3 Drawing Sheets

ARRAY ANTENNA

The present invention relates to an antenna consisting of an array of dipole radiating elements. Although, for convenience, much of the description and explanation of the invention will employ terms appropriate to transmission, it will be appreciated that this is only a matter of convenience. Antennae and radiating elements are reciprocal devices and may be used in transmission mode and in reception mode as desired.

BACKGROUND OF THE INVENTION

It is well known to employ an array of elements which are individually not very directional to create an antenna which is highly directional. If the array is linear, the antenna beam is fan-shaped. If the array is two-dimensional, the beam is a pencil beam. The narrowness of the beam and hence the antenna gain are influenced in particular by the number of elements in the array.

Although not limited to any particular application, the invention has been conceived in the context of a particular problem, namely the provision of a receiving antenna for a DBS (direct broadcasting by satellite) receiver. Attention is currently concentrated mainly upon parabolic dish antennae for this purpose. Such antennae are large in all three dimensions and of inelegant appearance: their proliferation in residential areas will seriously degrade the environment. There exists a need for an antenna which does not suffer from these defects and which is also of a more inherently robust construction than a dish antenna with its struts supporting a feed-horn.

An array antenna offers the advantage of a robust construction but for DBS usage it is necessary to achieve a very high gain and make suitable provision for aiming the antenna at the desired geostationary satellite. If this were to be done purely by physical positioning (as with a dish antenna), the advantage of a flat, unobtrusive construction is largely lost. What is required is to be able to mount the antenna flat on a suitable wall or possibly roof surface. Moreover, the superficial dimensions of the antenna must be within reasonable bounds if it is to be possible to find suitable mounting areas, say no more than around 1m on the side or diameter. Nevertheless, it must be possible to pack in a large number of elements to get adequate gain which demands that the elements themselves be compact.

SUMMARY OF THE INVENTION

The object of the present invention is to provide an array antenna such as to meet the requirements outlined above.

According to the invention, there is provided an array antenna, comprising an array of dipoles formed in a microstrip structure having a dielectric layer sandwiched between a groundplane and a radiating conductive pattern, characterised in that each dipole has a plurality of parasitic elements adjacent thereto, all parasitic elements lying with the dipoles in a front plane parallel to the groundplane, so as to squint the main beam of the array.

Each dipole is preferably a folded dipole because the higher impedance of such a dipole facilitates design of a feed network. The parasitic elements could be reflectors but are preferably directors, for reasons explained below.

It will be appreciated that a radiating element formed by a dipole and adjacent parasitic elements will necessarily have an asymmetrical radiation pattern relative to the normal to the groundplane, because the parasitic elements are spaced laterally from the dipole, rather than in the direction of the boresight axis, as is the case with conventional aerials employing parasitic elements. This is not a disadvantage in the array antenna according to the invention.

It is well known that the beam of an array antenna can be steered electrically by adjusting the phases with which the elements of the array are fed—a so-called phased array. Although two-coordinate steering is theoretically possible, only one-coordinate steering is really practicable. In an important development of the invention, the beam of the antenna is aimed in a required look-direction by electrical beam-steering to vary the angle of squint of the beam and rotational adjustment of the antenna in the plane of the array. This makes it possible to mount the antenna flat against a suitable surface, which dictates the plane of the array, but nevertheless aim the beam anywhere within a cone of solid angles symmetrically disposed relative to the normal to the array.

The electrical beam-steering may provide only coarse steering, e.g. by 5° increments. In this case the exact angle of the beam relative to the normal to the mounting surface is established by a slight tilt of the antenna relative to this surface. Since this tilt need not exceed 2.5°, the departure from truly flat mounting is insignificant.

A particular embodiment of the invention has been developed for use as a DBS antenna operating at 11.9 GHz, at which frequency a wavelength is around 2.5 cm. Investigations showed that the pitch of the elements should be one wavelength in the direction of the dipoles but only 0.55 wavelength in the direction perpendicular to the dipoles. This yields a highly directional array with about 40 elements in the dipole direction and about 70 elements in the orthogonal direction, taken to be the column and row directions respectively. The elements of a column are all co-phased but the phase delay from column to column is adjusted to achieve the desired squint, which is the angle $\phi$ in spherical polar coordinates centered on the normal to the array. The rotational adjustment of the array in its own plane is the angle $\theta$.

Since the pitch along a row is only 0.55 wavelength it is necessary to be able to space the parasitic elements extremely closely to the dipole and to each other. It has been found possible to get five director elements in a space of only 0.1 wavelength. With such a close spacing the array is an array with supergain. With less than five elements the input impedance of an element was found to change too rapidly with frequency. As it is, the element has a bandwidth of only around 4% but this is adequate for its intended purpose.

The antenna is linearly polarised. Signals broadcast from a DBS satellite are circularly polarised. In the interests of efficiency and having regard to the fact that the plane of polarisation will be arbitrarily dictated by the $\theta$ angle selected for beam-steering purposes, it is desirable to dispose a polarisation converter (circular to linear, parallel to the dipoles) in front of the array of radiating elements.

BRIEF DESCRIPTION OF THE DRAWINGS

The invention will be described in more detail by way of example, with reference to the accompanying drawings, in which.

DESCRIPTION OF THE INVENTION

Figure 1:
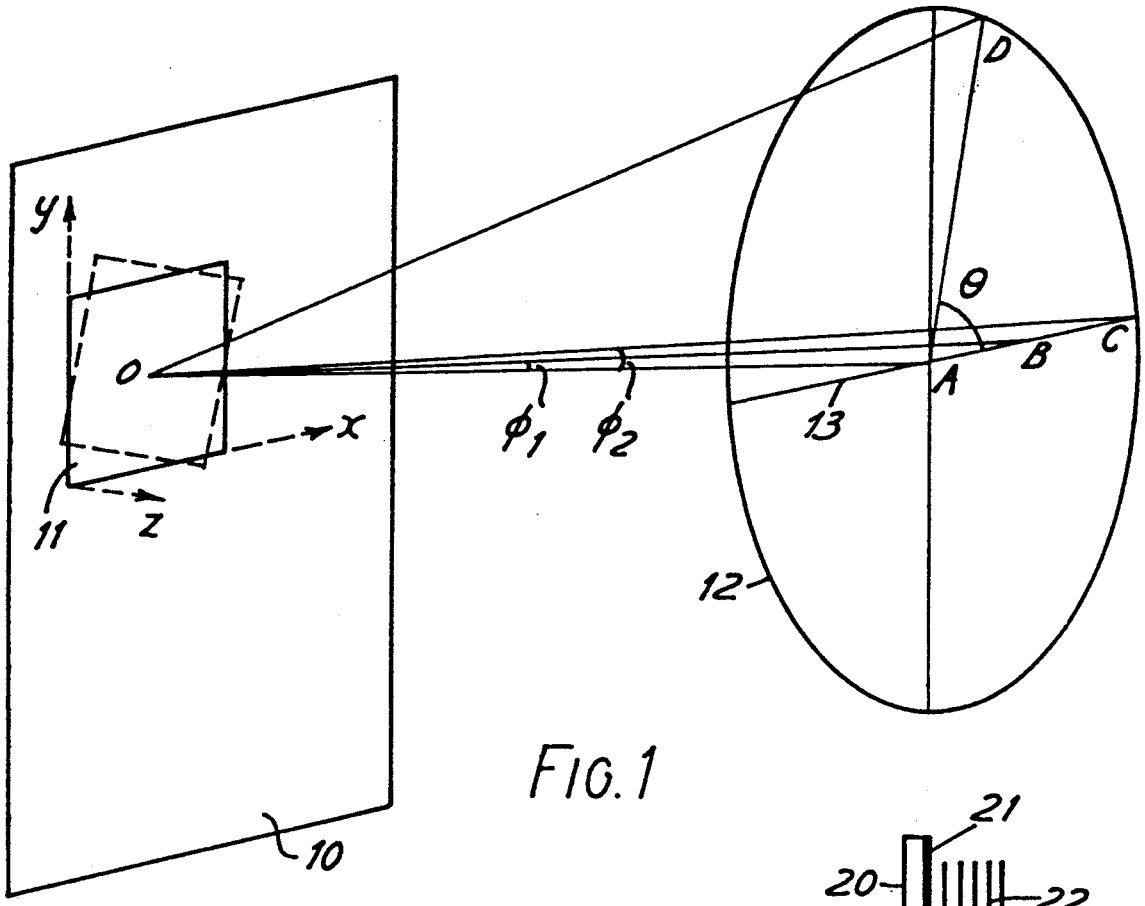
FIG. 1 illustrates beam-steering with an antenna according to the invention.

In FIG. 1 the rectangle 10 represents a wall with a generally southerly aspect on which is mounted a flat plate antenna 11 shown in full lines in an upright disposition (with the dipoles extending vertically) and defining horizontal and vertical coordinate axes X and Y in the plane of the wall and a horizontal axis Z normal to the plane of the wall. A vector OA is drawn from the centre of the antenna, parallel to the Z axis to the centre of a circle 12 with a horizontal diameter 13. A vector OB is drawn to a point B on this horizontal diameter 13, making an angle $\phi_1$ with the vector OA. The vector OB represents the squinted boresight axis of the antenna when the columns of dipoles are driven with a given phase shift between columns of elements. By adjusting the phase from column to column of the dipoles it is possible, in well known manner, to modify the look direction of the antenna and vector OC, making a larger angle $\phi_2$ with the vector OA, represents an adjusted, more highly squinted look direction for the antenna. By rotating the antenna 11 in its own plane anticlockwise through an angle $\theta$, to the position shown in broken lines, the vector OC is rotated into the vector OD which represents the desired look direction for the antenna, towards a geostationary satellite. It will be appreciated that, by rotating the antenna in its own plane, any desired look direction intersecting the circle 12 can be chosen. This applies at each possible value of the squint angle $\phi_2$ so that it is possible to achieve any desired look direction within a substantial cone of solid angles symmetrical about the Z axis.

Figure 2:
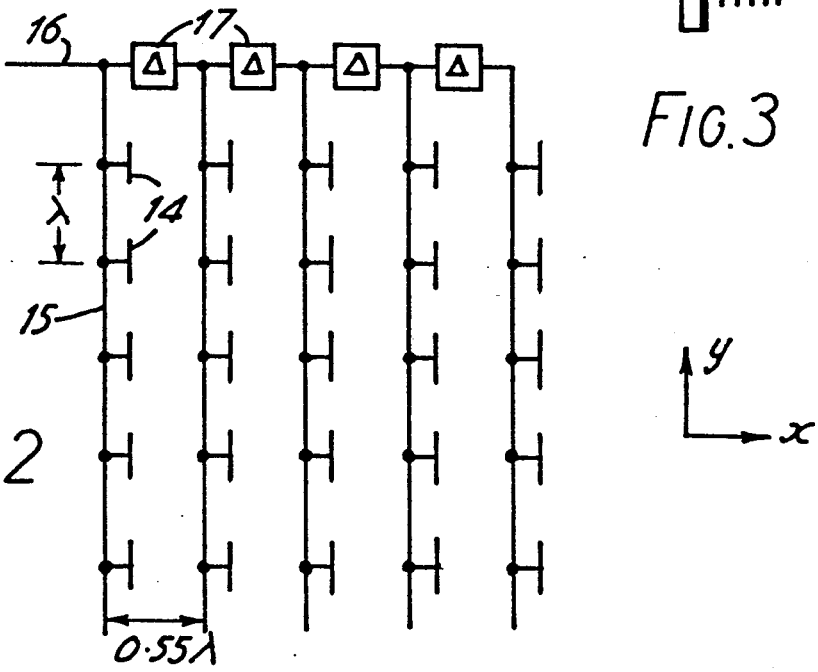
FIG. 2 is a schematic front view of an antenna embodying the invention, illustrating the electrical principles involved.

FIG. 2 is a highly symbolized representation of the antenna, in the upright position. For simplicity only a 5 by 5 array of dipoles 14 is shown. Each column of dipoles is fed off a vertical feeder 15 and, since the dipoles are spaced vertically by one wavelength, the dipoles in each column are all co-phased. The vertical feeders 15 are fed from a common feed 16 with phase delay devices 17 interposed to adjust the column to column phase delay so as to achieve the desired squint angle $\phi_2$.

Figure 3:
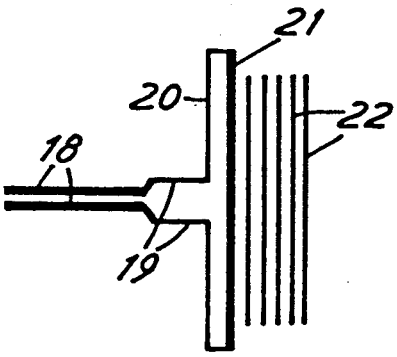
FIG. 3 is a front view of one radiating element of the antenna.
Figure 5:
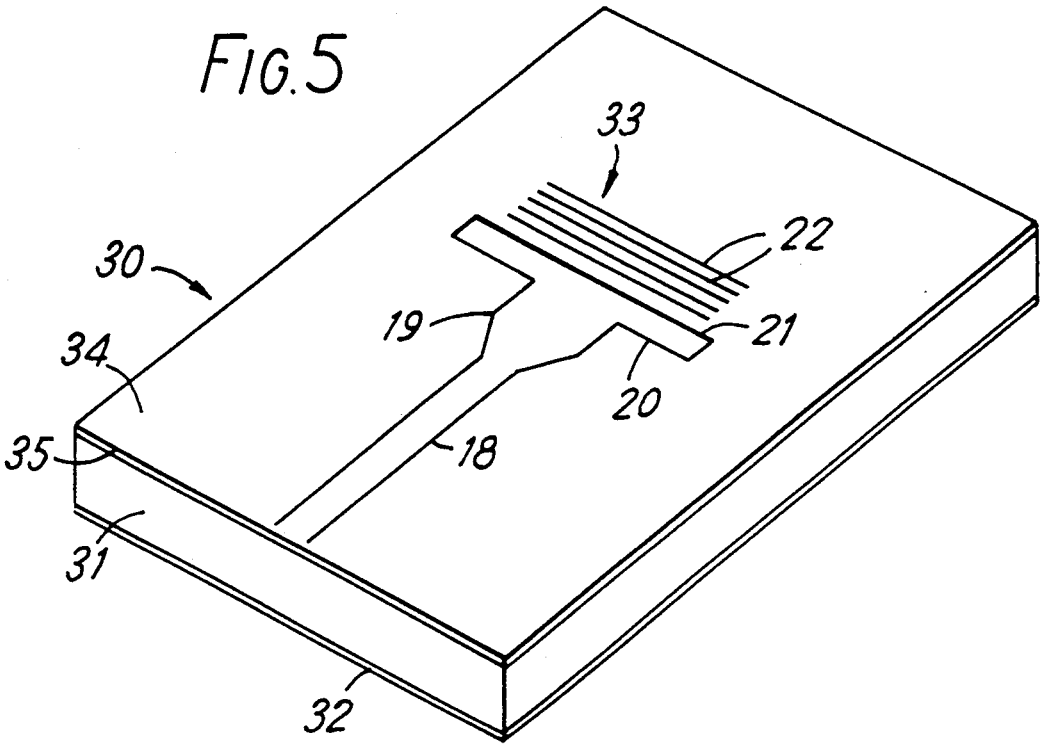
Figure 6:
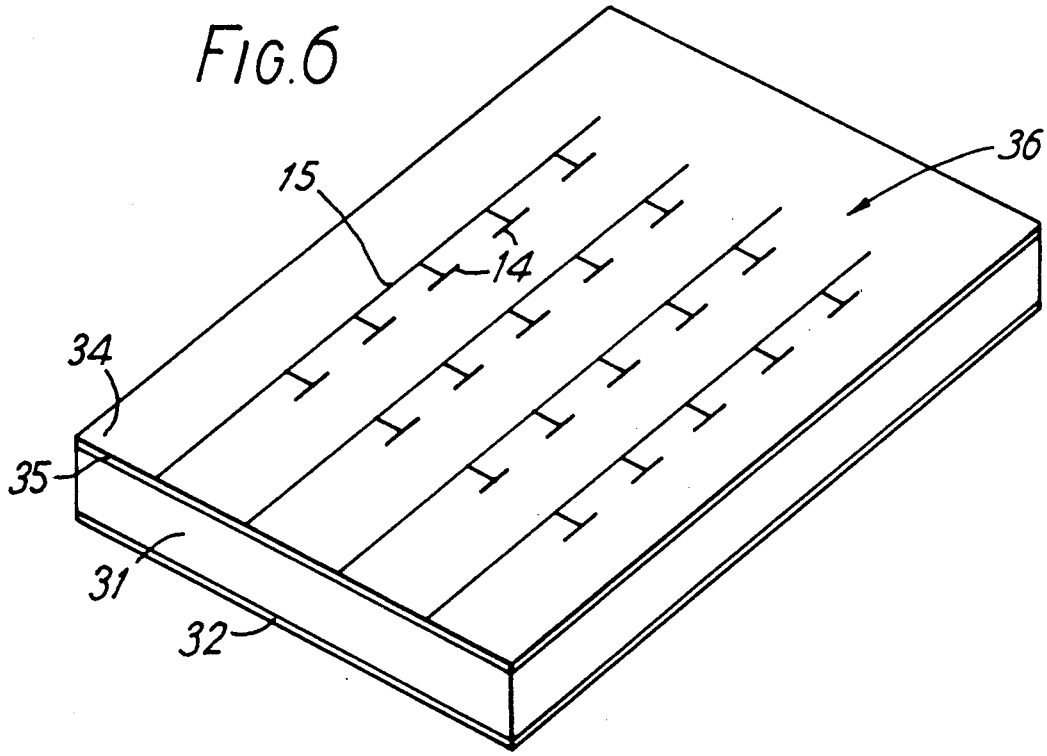
FIG. 6 shows a microstrip embodiment.

FIG. 2 is not intended to indicate the physical form of the feeders or the dipoles and the parasitic elements employed in the present invention are not shown. However, FIG. 3 shows one radiating element of the array in detail. The element has been designed by a mixture of modelling and empirical methods to suit a frequency around 11.9 GHz. As shown in FIGS. 5 and 6, the element is a microstrip element 30 comprising a dielectric layer 31 sandwiched between a groundplane 32 and a radiating conductive pattern 33 lying in a front plane 34 parallel to the groundplane. It is the said conductive pattern which is shown in FIG. 3. In a specific construction the conductive pattern is formed on a Kapton insulating film 35 0.05 mm thick and the dielectric layer is microwave foam 7.2 mm thick, i.e. the conductive pattern is spaced 7.2 mm from the groundplane. Other dielectric materials may be used (e.g. PTFE) but microwave foam has the advantages of low cost and a relatively low loss feed structure. FIG. 6 shows a similar structure for an array 36 such as shown in FIG. 2.

Turning now to the conductive pattern itself, a 200 ohm balanced feed line comprises two tracks 18 approximately 0.4 mm wide. The feed line is coupled to the dipole by a short length (1.9 mm) of 400 ohm line formed by narrower (0.2 mm) tracks 19, used to match out the imaginary component of the input impedance of the element. This technique only works over a narrow bandwidth but is satisfactory in an antenna intended for DBS use where the required bandwidth need be only 4%. The folded dipole itself consists of back elements 20 0.2 mm wide and a front element 21 0.4 mm wide. The overall length of the dipole is 10.4 mm. Adjacent the front element 21 are five directors 22 0.2 mm wide and spaced from each other and from the front element 21 by 0.3 mm. The director elements 22 have a length of 8.8 mm.

The feed network for the antenna can utilise a 50 ohm unbalanced coaxial line connected to a 50 ohm unbalanced microstrip line which is coupled to the balanced 200 ohm line by means of a balun introducing a 4:1 impedance transformation. Such a balun can consist of a half wavelength of microstrip line. The unbalanced microstrip line has an upper groundplane spaced 1.6 mm above the feed line by a second layer of microwave foam. The upper groundplane does not extend near the radiating elements themselves.

A radiating element utilising the conductive pattern of FIG. 3 has been extensively tested and exhibited a satisfactory input impedance, an absolute gain of between 8 dBi and 9 dBi and satisfactory co- and cross-polar radiation patterns. The co-polar radiation patterns exhibited the required element shaping in the H plane and a dipole pattern in the E plane. The cross-polar radiation level in the E plane was fairly high off-broadside but this would not be important in an array antenna because broadside is the wanted direction of the main beam in this plane.

Figure 4:
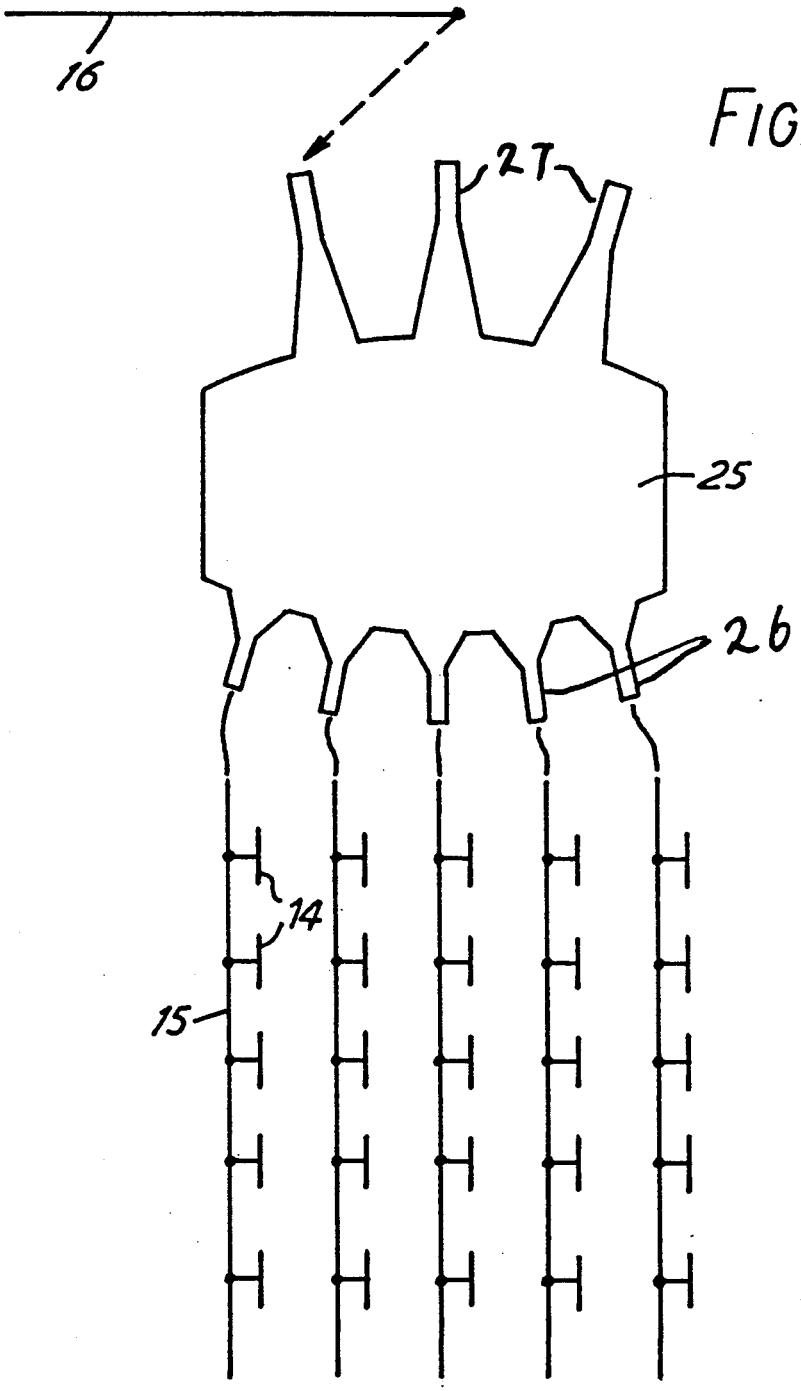
FIG. 4 is a view like FIG. 2 showing (very diagrammatically) a microwave lens used to determine the column-to-column phase delay, and FIG. 5

The phase delay devices may comprise a microwave lens 25 (FIG. 4) mounted at the back of the array and distributing energy to the different columns via array ports 26, with different path-length phase delays so as to establish the required squint angle. The lens has a plurality of beam ports 27, each corresponding to a different squint angle and the common feed 16 is coupled to that port 27 which gives the required squint angle. Since this arrangement will only allow coarse adjustment of the squint angle, fine adjustment is completed by slight tilting of the plane of the antenna 11 (FIG. 1) relative to the mounting surface 10.

I claim:

1. An array antenna, comprising a microstrip structure, comprising a groundplane, a front plane parallel to the groundplane and a dielectric layer sandwiched between said groundplane and said front plane;

an array of dipoles lying on the front plane; and means for squinting the main beam of the array away from a broadside direction at an acute angle relative to the normal to said front plane, said squinting means comprising said groundplane and a plurality of parasitic elements arranged substantially parallel to one another adjacent to each dipole of the dipole array, in an asymmetric pattern with respect to each dipole, said groundplane extending beneath the dipole array and the parasitic elements, said dipole array and said plurality of parasitic elements defining a radiating conductive pattern and said parasitic elements lying with said dipole array in said front plane.

2. An array antenna according to claim 1, wherein each dipole is a folded dipole.

3. An array antenna according to claims 1 or 2, wherein the parasitic elements are director elements.

4. An array antenna according to claim 3, wherein the director elements and the associated dipoles are spaced to define a supergain array.

5. An array antenna according to claim 4 wherein in the supergain array, each dipole has five parallel adjacent director elements, the distance between the dipole and the farthest director element from the dipole not exceeding one tenth of a wavelength at the operating frequency of the dipole.

6. An array antenna according to claims 1 or 2, wherein the dipoles and parasitic elements are formed by conductive deposits on an insulating film supported on the dielectric layer.

7. An array antenna according to claim 1 or 2, wherein the dielectric layer is a microwave foam layer.

8. An array antenna according to claims 1 or 2, wherein the dipoles are fed by a microstrip balanced line feeder.

9. An array antenna according to claim 8, wherein the microstrip line feeder is coupled to each dipole by a length of a balanced line of higher impedance than the microstrip line feeder, the length of higher impedance line being short in comparison with the length of the microstrip line feeder.

10. An array antenna according to any of claim 1 or 2 wherein the dipoles and associated parasitic elements are arranged in columns, the antenna further comprising a feed network including phase delay means located between adjacent columns of dipoles and associated parasitic elements for establishing delays from column to column to adjust the squint angle of the antenna.

11. An array antenna according to claim 10, wherein the phase delay means comprises a microwave lens having array ports coupled to respective columns of dipoles, beam ports corresponding to different squint angles of the antenna, and means for coupling a common feed to a selected one of the beam ports.

12. An array antenna according to claim 10 further comprising a method for using the antenna including mounting the antenna flat, against a supporting surface, and aiming the antenna at a signal source by adjusting the phase delay means to establish a selective delay from column to column, thereby selecting a desired squint angle and rotating the antenna in its own plane through a desired angle thereby selecting a desired orientation.

13. An array antenna according to claim 11 further comprising a method for using the antenna including mounting the antenna substantially flat against a supporting surface, and aiming the antenna at a signal source (a) by effecting a coarse selection of the squint angle of the main antenna beam, by selecting one of the beam ports of the microwave lens for coupling with the common feed, and (b) by effecting fine adjustment of the squint angle by tilting the plane of the antenna relative to the normal of the supporting surface, and adjusting the orientation of the antenna within its own plane.

14. An array antenna comprising:

a microstrip structure, comprising a groundplane, a front plane parallel to the groundplane and a dielectric layer sandwiched between said groundplane and said front plane;

an array of dipoles lying on the front plane; and means for squinting the main beam of the array away form a broadside direction at an acute angle relative to the normal to the front plane, said means comprising said groundplane and plurality of parasitic elements arranged substantially parallel to one another adjacent to each of the dipoles of said dipole array, in an asymmetric pattern with respect to each pattern, said groundplane extending beneath the dipole array and the parasitic elements, said dipole array and said plurality of parasitic elements defining a radiating conductive pattern and being formed by conductive deposits on an insulating film supported on the dielectrical layer, said radiating conductive pattern and said insulating film lying in said front plane.

15. An array antenna comprising:

a microstrip structure, comprising a groundplane, a front plane parallel to the groundplane and dielectric layer sandwiched between said groundplane and said front plane;

an array of dipoles arranged in a plurality of adjacent columns and lying in a front plane, the dipoles in each column being connected by a common feedline;

means for squinting the main beam of the array away from a broadside direction at an acute angle relative to the normal to the front plane, said means comprising said groundplane and a plurality of parasitic elements arranged substantially parallel to one another adjacent to each of the dipoles of the dipole array, in an asymmetric pattern with respect to each dipole, said groundplane extending beneath the dipole array and the parasitic elements, the dipole array and parasitic elements defining a radiating conductive pattern lying in said front plane; and means for adjusting the squint angle of the main beam, comprising means for establishing phase delays between adjacent columns of dipoles.

16. An array antenna, comprising:

a microstrip structure, comprising a groundplane, a front plane parallel to the groundplane and a dielectric layer sandwiched between said groundplane and said front plane;

an array of dipoles lying on the front plane; and means for squinting the main beam of the array away from a broadside direction at an acute angle relative to the normal to the front plane, said means comprising said groundplane and a plurality of parasitic elements arranged substantially parallel to one another adjacent to each dipole of the dipole array, said groundplane extending beneath the dipole array and the parasitic elements, said dipole array and said plurality of parasitic elements defining a radiating conductive pattern and said parasitic elements lying with said dipole array in said front plane, wherein the parasitic elements are director elements and each dipole has five parallel adjacent director elements, the distance between the dipole and the farthest director element from the dipole not exceeding one tenth of a wavelength at the operating frequency of the dipole so that the director elements and the associated dipoles define a supergain array, and wherein;

the dipoles and parasitic elements are formed by conductive deposits on an insulating film supported on the dielectric layer.

17. An array antenna, comprising:

a microstrip structure, comprising a groundplane, a front plane parallel to the groundplane and a dielectric layer sandwiched between said groundplane and said front plane;

an array of dipoles lying on the front plane; and means for squinting the main beam of the array away from a broadside direction at an acute angle relative to the normal to said plane, said squinting means comprising said groundplane and a plurality of parasitic elements arranged substantially parallel to one another adjacent to each dipole of the dipole array, said groundplane extending beneath the dipole array and the parasitic elements, said dipole array and said plurality of parasitic elements defining a radiating conductive pattern and said parasitic elements lying with said dipole array in said front plane wherein;

the dipoles and parasitic elements are formed by conductive deposits on an insulating film supported on said dielectric layer, and wherein said dielectric layer is a microwave foam layer.

18. An array antenna, comprising:

a microstrip structure, comprising a groundplane, a front plane parallel to the groundplane and a dielectric layer sandwiched between said groundplane and said front plane;

an array of dipoles lying on the front plane; and means squinting the main beam of the array away from a broadside direction at an acute angle relative to the normal to said plane, said squinting means comprising said groundplane and a plurality of parasitic elements arranged substantially parallel to one another adjacent to each dipole of the dipole array, said groundplane extending beneath the dipole array and the parasitic elements, said dipole array and said plurality of parasitic elements defining a radiating conductive pattern and said parasitic elements lying with said dipole array in said front plane wherein;

the parasitic elements are director elements and each dipole has five parallel adjacent director elements, the distance between the dipole and the farthest director element from the dipole not exceeding one tenth of a wavelength at the operating frequency of the dipole whereby the director elements and the associated dipoles define a supergain array, wherein;

the dielectric layer is a microwave foam layer.

19. An array antenna, comprising:

a microstrip structure, comprising a groundplane, a front plane parallel to the groundplane and a dielectric layer sandwiched between said groundplane and said front plane;

an array of dipoles lying on the front plane; and means for squinting the main beam of the array away from a broadside direction at an acute angle relative to the normal to said plane, said squinting means comprising said groundplane and a plurality of parasitic elements arranged substantially parallel to one another adjacent to each dipole of the dipole array, said groundplane extending beneath the dipole array and the parasitic elements, said dipole array and said plurality of parasitic elements defining a radiating conductive pattern and said parasitic elements lying with said dipole array in said front plane, wherein the dipoles and associated parasitic elements are arranged in columns, the antenna further comprising a feed network including phase delay means located between adjacent columns of dipoles and associated parasitic elements for establishing delays from column to column to adjust the squint angle of the antenna, the phase delay means comprising a microwave lens having array ports coupled to respective columns of dipoles and parasitic elements, beam ports corresponding to different squint angles of the antenna, and means for coupling a common feed to a selected one of the beam ports.

20. An array antenna, comprising:

a microstrip structure, comprising a groundplane, a front plane parallel to the groundplane and a dielectric layer sandwiched between said groundplane and said front plane;

an array of dipoles lying on the front plane; and means for squinting the main beam of the array away from a broadside direction at an acute angle relative to the normal to said plane, said squinting means comprising said groundplane and a plurality of parasitic elements arranged substantially parallel to one another adjacent to each dipole of the dipole array, said groundplane extending beneath the dipole array and the parasitic elements, said dipole array and said plurality of parasitic elements defining a radiating conductive pattern and said parasitic elements lying with said dipole array in said front plane, wherein the parasitic elements are director elements and each dipole has five parallel adjacent director elements, the distance between the dipole and the farthest director element from the dipole not exceeding one tenth of a wavelength at the operating frequency of the dipole, whereby the director elements and associated dipoles define a supergain array.

21. An array antenna, comprising:

a microstrip structure, comprising a groundplane, a front plane parallel to the groundplane and a dielectric layer sandwiched between said groundplane and said front plane;

an array of dipoles lying on the front plane; and means for squinting the main beam of the array away from a broadside direction at an acute angle relative to the normal to said plane, said squinting means comprising said groundplane and a plurality of parasitic elements arranged substantially parallel to one another adjacent to each dipole of the dipole array, said groundplane extending beneath the dipole array and the parasitic elements, said dipole array and said plurality of parasitic elements defining a radiating conductive pattern and said parasitic elements lying with said dipole array in said front plane, wherein the dipoles are fed by microstrip balanced line feeder coupled to each dipole by a length of a balanced line of higher impedance than the microstrip line feeder, the length of higher impedance line being short in comparison with the length of the microstrip line feeder.

22. An array antenna, comprising:

a microstrip structure, comprising a groundplane, a front plane parallel to the groundplane and a dielectric layer sandwiched between said groundplane and said front plane;

an array of dipoles lying on the front plane; and means for squinting the main beam of the array away from a broadside direction at an acute angle relative to the normal to said plane, said squinting means comprising said groundplane and a plurality of parasitic elements arranged substantially parallel to one another adjacent to each dipole of the dipole array, said groundplane extending beneath the dipole array and the parasitic elements, said dipole array and said plurality of parasitic elements defining a radiating conductive pattern and said parasitic elements lying with said dipole array in said front plane, wherein the dipoles and associated parasitic elements are arranged in interconnected columns, the antenna further comprising a feed network including phase delay means located between adjacent columns of dipoles and associated parasitic elements for establishing delays from column to column to adjust the squint angle of the antenna.

23. An array antenna, comprising:

a microstrip structure, comprising a groundplane, a front plane parallel to the groundplane and a dielectric layer sandwiched between said groundplane and said front plane;

an array of dipoles lying on the front plane; and means for squinting the main beam of the array away from a broadside direction at an acute angle relative to the normal to said plane, said squinting means comprising said groundplane and a plurality of parasitic elements arranged substantially parallel to one another adjacent to each dipole of the dipole array, said groundplane extending beneath the dipole array and the parasitic elements, said dipole array and said plurality of parasitic elements defining a radiating conductive pattern and said parasitic elements lying with said dipole array in said front plane, wherein the dipoles and associated parasitic elements are arranged in interconnected columns, the antenna further comprising a feed network including phase delay means located between adjacent columns of dipoles and associated parasitic elements for establishing delays from column to column to adjust the squint angle of the antenna, and wherein the parasitic elements are director elements and each dipole has five parallel adjacent director elements, the distance between the dipole and the farthest director element from the dipole not exceeding one tenth of a wavelength at the operating frequency of the dipole.

24. An array antenna, comprising:

a microstrip structure, comprising a groundplane, a front plane parallel to the groundplane and a dielectric layer sandwiched between said groundplane and said front plane;

an array of dipoles lying on the front plane; and means for squinting the main beam of the array away from a broadside direction at an acute angle relative to the normal to said plane, said squinting means comprising said groundplane and a plurality of parasitic elements arranged substantially parallel to one another adjacent to each dipole of the dipole array, said groundplane extending beneath the dipole array and the parasitic elements, said dipole array and said plurality of parasitic elements defining a radiating conductive pattern and said parasitic elements lying with said dipole array in said front plane, wherein the dipoles are fed by a microstrip balanced line feeder coupled to each dipole by a length of a balanced line of higher impedance than the microstrip line feeder, the length of higher impedance line being short in comparison with the length of the microstrip line feeder, wherein the dipoles and associated parasitic elements are arranged in interconnected columns, the antenna further comprising a feed network including phase delay means located between adjacent columns of dipoles and associated parasitic elements for establishing delays from column to column to adjust the squint angle of the antenna.

25. An array antenna, comprising:

a microstrip structure, comprising a groundplane, a front plane parallel to the groundplane and a dielectric layer sandwiched between said groundplane and said front plane;

an array of dipoles lying on the front plane; and means for squinting the main beam of the array away from a broadside direction at an acute angle relative to the normal to said plane, said squinting means comprising said groundplane and a plurality of parasitic elements arranged substantially parallel to one another adjacent to each dipole of the dipole array, said groundplane extending beneath the dipole array and the parasitic elements, said dipole array and said plurality of parasitic elements defining a radiating conductive pattern and said parasitic elements lying with said dipole array in said front plane, wherein the dipoles and associated parasitic elements are arranged in interconnected columns, the antenna further comprising a feed network including phase delay means located between adjacent columns of dipoles and associated parasitic elements for establishing delays from column to column to adjust the squint angle of the antenna further comprising a method for using the antenna including mounting the antenna flat, against a supporting surface, and aiming the antenna at a signal source by adjusting the phase delay means to establish a selective delay from column to column, thereby selecting a desired squint angle and rotating the antenna in its own plane through a desired angle thereby selecting a desired orientation.

26. An array antenna, comprising:

a microstrip structure, comprising a groundplane, a front plane parallel to the groundplane and dielectric layer sandwiched between said groundplane and said front plane;

an array of dipoles lying on the front plane; and means for squinting the main beam of the array away from a broadside direction at an acute angle relative to the normal to said plane, said squinting means comprising said groundplane and a plurality of parasitic elements arranged substantially parallel to one another adjacent to each dipole of the dipole array, said groundplane extending beneath the dipole array and the parasitic elements, said dipole array and said plurality of parasitic elements defining a radiating conductive pattern and said parasitic elements lying with said dipole array in said front plane, wherein the dipoles and associated parasitic elements are arranged in columns, the antenna further comprising a feed network including phase delay means located between adjacent columns of dipoles and associated parasitic elements for establishing delays from column to column to adjust the squint angle of the antenna, the phase delay means comprising a microwave lens having array ports coupled to respective columns of dipoles and parasitic elements, beam ports corresponding to different squint angles of the antenna, and means for coupling a common feed to a selected one of the beam ports corresponding to different squint angles of the antenna, and means for coupling a common feed to a selected one of the beam ports, further comprising a method for using the antenna including mounting the antenna substantially flat against a supporting surface, and aiming the antenna at a signal source (a) by effecting a coarse selection of the squint angle of the main antenna beam, by selecting one of the beam ports of the microwave lens for coupling with the common feed, and (b) by effecting fine adjustment of the squint angle by tilting the plane surface, and adjusting the orientation of the antenna within its own plane.

* * * * *